United States Patent [19]

Vann et al.

[11] Patent Number: 4,749,039

[45] Date of Patent: Jun. 7, 1988

[54] GUN FIRING SYSTEM USING FLUID FILLED PRESSURE BALANCE TUBING

[75] Inventors: Roy R. Vann, Katy, Tex.; Emmet F. Brieger, Albuquerque, N. Mex.; Flint R. George, Katy; Edward A. Colle, Jr., Houston, both of Tex.; Hilton B. Jones, Albuquerque, N. Mex.

[73] Assignee: Halliburton Company, Duncan, Okla.

[21] Appl. No.: 896,554

[22] Filed: Aug. 14, 1986

Related U.S. Application Data

[60] Division of Ser. No. 736,872, May 22, 1985, Pat. No. 4,635,733, which is a continuation of Ser. No. 385,707, Jun. 7, 1982, abandoned.

[51] Int. Cl.[4] ..... E21B 43/112

[52] U.S. Cl. ..... 166/297

[58] Field of Search ..... 166/297–299, 166/63, 55; 175/2–4.6; 102/310–314

[56] References Cited

U.S. PATENT DOCUMENTS

| | | | |
|---|---|---|---|
| 2,760,408 | 8/1956 | Taylor | 166/55 X |
| 4,040,485 | 8/1977 | Vann et al. | 166/297 |
| 4,299,287 | 11/1981 | Vann et al. | 166/297 |
| 4,330,039 | 5/1982 | Vann et al. | 166/297 |
| 4,538,680 | 9/1985 | Brieger et al. | 166/55 |

*Primary Examiner*—Stephen J. Novosad
*Assistant Examiner*—Thuy M. Bui
*Attorney, Agent, or Firm*—James R. Duzan

[57] ABSTRACT

Method and apparatus by which a gun firing head is maintained free of debris. An upper tubing string runs downhole in a cased borehole to a packer device. A jet gun, having a firing head located at the upper end thereof, is connected to a lower tubing string. A vent assembly is connected in series relationship within the lower string, and underlies the packer device. A barrier is contained within the lower tubing in underlying relationship to the vent and isolates the tubing interior immediately above the gun from contact with well fluids. A gun firing device is run from the surface, downhole through the packer device, and penetrates the barrier to gain access to the gun firing head, whereupon the gun is detonated, thereby perforating the casing and penetrating the payzone. Production occurs back through the perforations, up through the lower annulus, into the vent, and up the lower tubing string, through the packer, and up through the upper tubing string to the surface of the earth where the production is gathered.

7 Claims, 2 Drawing Sheets

GUN FIRING SYSTEM USING FLUID FILLED PRESSURE BALANCE TUBING

This application is a division of U.S. patent application Ser. No. 736,872, filed May 22, 1985 now U.S. Pat. No. 4,635,733, which is a continuation of U.S. patent application Ser. No. 385,707, filed June 7, 1982 and now abandoned.

REFERENCE TO RELATED PATENT APPLICATIONS

The aforesaid application Ser. No. 385,707 and application Ser. No. 736,872 application are part of a group of patent applications assigned to a common assignee all contemporaneously filed and relating to bottom hole completions, including patent application Ser. No. 384,508 filed June 3, 1982 entitled "Gun Below Packer Completion Tool String" now U.S. Pat. No. 4,538,680; patent application Ser. No. 385,708 filed June 7, 1982 entitled "Well Cleanup and Completion Method and Apparatus" now U.S. Pat. No. 4,510,999; and patent application Ser. No. 383,746 filed June 1, 1982 entitled "Well Cleanup and Completion Apparatus" now U.S. Pat. No. 4,436,155. Other related patents and applications of assignee include U.S. Pat. No. 4,040,482 entitled "Optional Fire and Release Tool and Method" and U.S. patent application Ser. No. 175,515, filed Aug. 5, 1980 entitled "Ball Switch Revise and Method" now abandoned. These cited patents and applications and the art cited with respect thereto are presented to the U.S. Patent and Trademark Office in order to make full disclosure of applicants prior art knowledge.

BACKGROUND OF THE INVENTION

This invention relates to well completions in which a perforating gun and a packer are run into a well together on a string of tubing, with the perforating gun detonator initially sealed off from the tubing string by a frangible disc, with a vent between the disc and packer to allow formation fluid to enter the tubing after the formation is perforated. The gun may be released and dropped to bottom.

The completion of wells by employment of permanent completion devices is known to those skilled in the art as evidenced by the following Vann U.S. Pat. Nos.: 3,706,344; 3,871,448; 3,966,26; and 4,066,282. In carrying out permanent completion techniques, it is advantageous to employ packer actuated vent assemblies and perforating guns such as disclosed in the above-mentioned patents. Various different packers, including permanent packers, are known such as described, for example, in the 1974–1975 Baker Catalog, Section III, IV, and V (Baker Oil Tools, Inc., P.O. Box 3048, Houston, Tex. 77001).

After a borehole has been drilled into the ground and the casing cemented into position, a considerable amount of time may expire before the well is completed and suitably connected into a gathering system. When a tool string is run into the well open, the well fluid fills the tool string with drilling mud and debris. When such a string of tools has been left downhole for a period of time, the mud and debris begin to gravitate towards the lower end of the string and begin to densify and congeal into a heavy layer of material. The longer the tool string is left downhole, the more mud is permitted to settle and congeal.

Such contamination of the interior of the tool string can also occur even when the tool string is run into the well closed such that the drilling mud cannot flow into the tubing string. Debris inside the tubing string, such as flakes, rust, sand, scale and other material dropped into the well from the surface, tends to collect in the bottom of the string. Often such debris becomes dislodged and falls down into the tubing string as the tubing string is handled and lowered into the well. Again, the heavy particles and other suspended matter will gravitate to the bottom of the tool string where such contaminants densify into a heavy layer of material. Thus, even though there is no drilling mud which settles and congeals, debris still may tend to collect and settle in the string.

In a perforating gun having a bar actuated gun firing head for example, it is possible for such contaminants to densify and collect about the gun firing head mechanism and become so compacted and viscous that the gun firing head cannot be sufficiently impacted to detonate the perforating gun. The firing mechanism generally requires 20 ft-lbs of impact for detonation. The debris can be so compacted and packed that the bar may be unable to sufficiently strike the firing mechanism with 20 ft-lbs of force. Thus, a misfire could occur because of the accumulation of debris that enters the tubing string and contaminates th firing mechanism. The problem of contamination is of course compounded when the perforating tool string is left downhole for a substantial length of time.

The amount of debris which will prevent detonation will vary depending upon how hard the debris is packed over the firing mechanism. Even an inch or two of debris, if packed down, may prevent a sufficient impact of the bar to detonate the gun.

The well completion method and apparatus of the present invention is particularly applicable in wells having a depth, temperature, and formation pressure which will permit the use of a retrievable packer mounted on a tubing string for supporting a perforating gun within the well. The present invention discloses two different embodiments, one embodiment including an open system where the tool string is run into the well wet, i.e., the drilling mud is permitted to flow into the tubing string, and another embodiment for a closed system, i.e., the drilling mud is not permitted to flow into the tubing string.

Accordingly, it is desirable to have a perforating tool string which is arranged in a manner whereby the lower borehole annulus is isolated from the passageway immediately above the gun firing head. The elimination of the contaminants from the lower tubing string has been found to greatly enhance the operation of the perforating gun. The present invention prevents the mud and debris from collecting around the firing mechanism by isolating the firing mechanism in a fluid tube. Further, it is advantageous to not only isolate the firing mechanism, but also easily permit access to the gun firing head upon detonation. The method and apparatus for accomplishing these purposes is the subject of the present invention.

SUMMARY OF THE INVENTION

This invention relates to method and apparatus for completing a formation located below the surface of the earth through which a cased borehole extends. A jet perforating gun is connected within a tool string and suspended adjacent to the payzone. The tool string includes a packer device which divides the borehole into a lower and upper annular area. A vent means underlies the packer, and the gun is attached to the lower end of a tubing string. A barrier means is connected in underlying relationship respective to the vent means and isolates the interior of the gun firing head from well fluid, which prevents malfunction of the gun due to contamination thereof from debris.

A gun firing device is run downhole from the surface of the earth, through the tubing string, through the vent means, through the barrier means, and into contact with the gun firing head, whereupon the gun is detonated, thereby perforating the casing wall and forming tunnels back up into the payzone. Formation fluid flows back through the tunnels, into the lower borehole annulus, up the annulus to the vent means, into the lower tubing string, up through the packer means, and up through the upper tubing string to the surface of the earth where the produced fluid is gathered.

The barrier means prevents debris from gravitating down the lower tubing string and contaminating or obscuring the gun firing mechanism. The barrier means preferably is in the form of a piston which can be reciprocated uphole and downhole a limited distance to allow for expansion and/or contraction of the fluid below the piston due to changes in pressure and temperature, with a frangible disk means forming a closure member for the piston. In one form of the invention, the disk means is a thin circle of metal, such as brass, which is ruptured when the gun firing mechanism is lowered with sufficient velocity down through the tubing string.

In the preferred form of the invention, the gun firing mechanism is a bar which gravitates down through the tubing string and impacts against the disk. This action ruptures the disk and the bar continues to fall downhole until it impacts against the gun firing head with sufficient force to detonate the charge of the gun firing head which detonates the shaped charges of the gun.

Accordingly, a primary object of the present invention is the provision of method and apparatus by which a payzone located downhole adjacent to the borehole can be completed in a safe and dependable manner.

Another object of the present invention is the provision of a well perforating apparatus which is suspended downhole in a borehole and isolated from well fluids to enable a formation to be completed at some subsequent time while avoiding contamination of the perforating device during the meanwhile.

A still further object of this invention is the provision of a method of containing uncontaminated fluid above a gun firing head of a perforating gun until it is desired to detonate the gun.

Another and still further object of this invention is the provision of apparatus by which a passageway leading downhole in a borehole to a perforating gun is maintained isolated from the gun firing head until it is desired to detonate the gun and complete the well.

An additional object of the present invention is the provision of method and apparatus for isolating the immediate area above the firing head of a perforating gun located downhole of a borehole until the well is subjected to a completion operation at some subsequent time.

A further object of this invention is the provision of a system for detonating a perforating gun which maintains the vital components of the perforating gun uncontaminated by well fluids until it is desired to fire the gun and perforate the casing.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above summary.

BRIEF DESCRIPTION OF THE DRAWINGS

FIG. 6 is a view similar to FIG. 2 but showing the vent and barrier and detonating parts of the FIG. 1 apparatus, with the barrier in its condition subsequent to breaking of the barrier.

DETAILED DESCRIPTION OF THE PREFERRED EMBODIMENT

Figure 1:
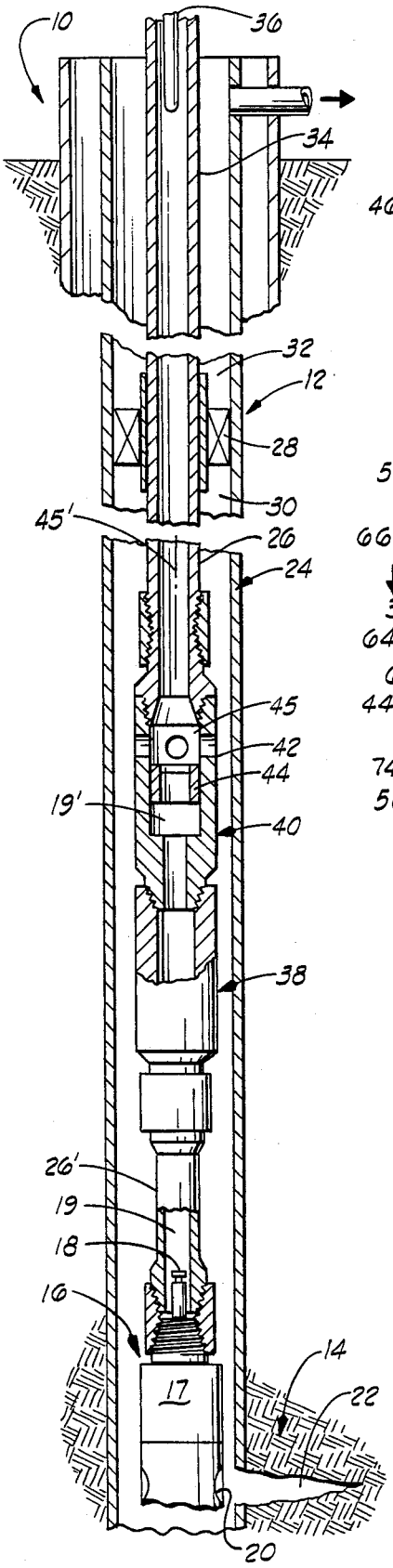
FIG. 1 is a partly diagrammatic, partly schematic, partly cross-sectional representation of a borehole having apparatus contained therewithin made in accordance with the present inven tion.

In FIG. 1 of the drawings, there is disclosed a wellhead 10 connected to the top of a cased borehole 12 which extends downhole into the earth and through a payzone 14. A perforating gun 16, for example, a casing gun such as described in U.S. Pat. Nos. 3,706,344 and 4,140,188, is suspended adjacent to the payzone. The gun includes a gun firing head 17 which is actuated when a pin assembly 18 is impacted with sufficient force. The pin assembly resides within chamber 19. The gun firing head detonates the individual shaped charges 20 of the gun carrier to penetrate the casing wall and form tunnels 22 back up into the formation.

Figure 2:
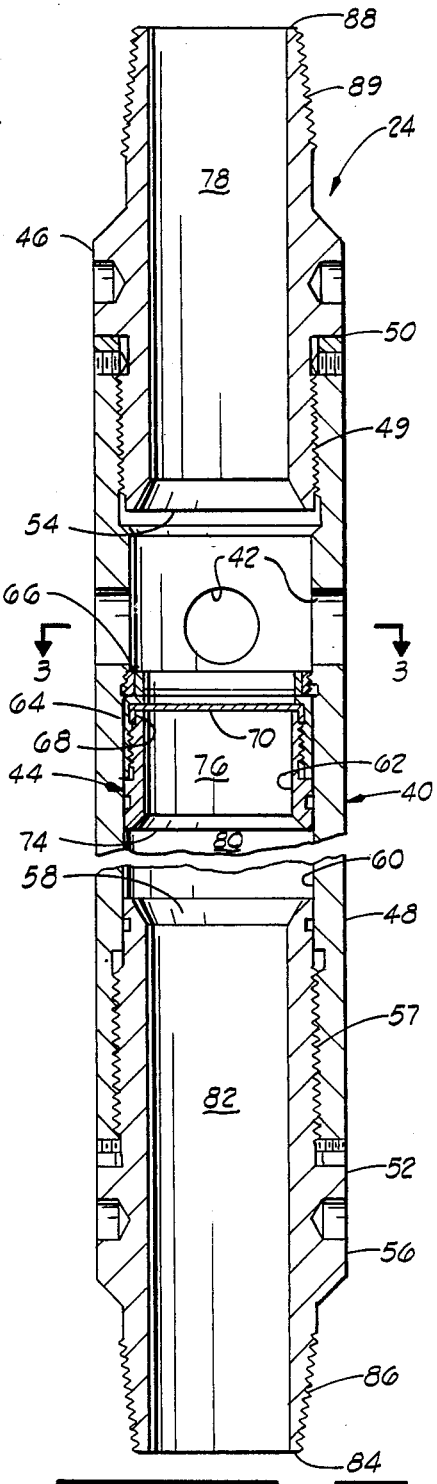
FIG. 2 is an enlarged, detailed, cross-sectional view of the vent and barrier parts of the apparatus disclosed in FIG. 1 with the barrier in its condition prior to breaking of the barrier.

Numeral 24 of FIGS. 1, 2, and 6 broadly indicates a tool string made in accordance with the present invention. As seen in FIG. 1, the tool string is connected within a tubing string 26, 26', hereinafter called "the lower tubing string." The lower tubing string is connected to a commercially available packer means 28, which can take on several different forms, and which divides the borehole annulus into a lower annulus 30 and an upper annulus 32. An upper tubing string 34 is connected to the packer and extends up to the surface of the earth, so that when the well is completed, production fluid can flow from the payzone, up to the wellhead, and to a gathering system. Numeral 36 indicates a detonating means by which the pin assembly of the gun firing head is impacted with sufficient force to detonate the shaped charges of the gun.

A tubing release assembly 38, made in accordance with U.S. Pat. Nos. 3,966,236 or 4,006,282, is optionally included within the tool string of the present invention so that after the casing has been perforated, the lower string can be parted at 38 and the entire gun assembly dropped down into the rat hole, if desired.

A barrier assembly 40, made in accordance with the present invention, is connected in underlying relationship respective to a vent assembly 42.

The barrier assembly includes a pressure equalizing piston assembly 44 reciprocatingly received in sealed relationship within the illustrated housing of the subassembly 40. The piston has a frangible closure means associated therewith which can be ruptured as the detonator, or bar 36, passes therethrough enroute to the gun firing head. The piston and closure means isolate the fluid filled chamber 19 and 19' from the tubing interior 45 and 45' located above the piston.

FIGS. 2, 3, 5, and 6 set forth the details of the tool string subassembly 40 of the present invention. As particularly seen illustrated in FIG. 2, the subassembly includes an upper connecting member 46 which is threadedly attached to the barrier main body 48 by means of the threaded surface 49. The upper terminal end 50 of the barrier main body is opposed to the lower terminal end 52 thereof. The lower end of member 46 terminates at edge portion 54. A lower connecting member 56 threadedly engages the lower marginal end of the barrier main body at 57. The upper terminal end 58 of the lower connecting member forms a stop means which limits the downward travel of piston assembly 44. Cylinder wall 60 reciprocatingly receives the piston assembly in sealed relationship therewithin.

Figure 3:
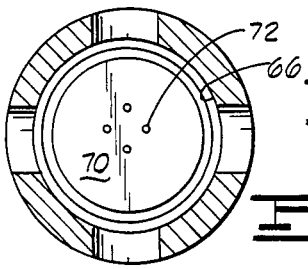
FIG. 3 is a cross-sectional view taken along line 3—3 of FIG. 2.
Figure 5:
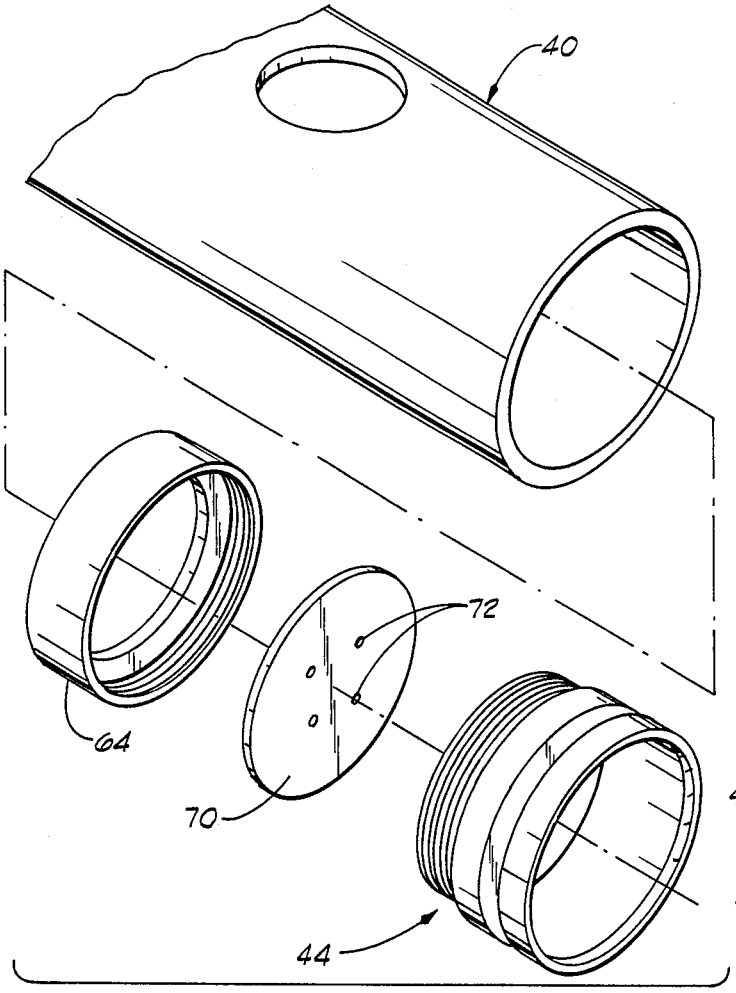
FIG. 5 is an enlarged, broken, isolated, perspective view of part of the apparatus disclosed in FIG. 3.

As seen in FIGS. 2, 3, and 5, the piston of assembly 44 is of annular construction and includes an inner circumferentially extending wall 62. A jam nut 64 forms the upper portion of the piston and abuttingly engages an upper stop member 66, when the piston is reciprocated to its upper limit of travel. The jam nut cooperates with the piston body to form a circumferentially extending slot 68 within which there is received the outer peripheral edge portion of a disk 70.

The tubing 26' located below piston 44 is filled with a light fluid such as water. Other fluids that may be used include diesel oil and light crude. The piston assembly 44 together with disk 70 prevents the circulating or cleaning fluid from passing from the tubing string 26 into the lowermost tubing 26'. Piston assembly 44 and the lowermost tubing 26' thereby prevent any mud from collecting around the isolated firing mechanism 18.

Piston 44 is located approximately 30 feet above firing mechanism 18 so that should mud or debris somehow inadvertently settle in the tubing string 34, and thereby slow the descent of detonator bar 36, bar 36 would have a minimum of at least 30 feet to drop through a clean fluid located below piston assembly 44. This unusual feature of the invention enables the bar to accelerate and to pick up sufficient velocity to insure a substantial impact on firing mechanism 18 to detonate gun 16.

The disk 70 preferably is made of 0.005 shim stock, such as brass or copper shim stock. The disk forms the before-mentioned closure means for the piston, and optionally includes very small pin holes 72 formed therethrough, through which compressed fluid (e.g. air) can be expelled upon assembly, and through which liquid can weep when the pressure differential across the barrier is positive.

The lower end 74 of the piston abuttingly engages the upper end 58 of the lower connecting member when the piston is reciprocated into the lowermost position. Passageway 76 extends through the piston when the closure means 70 is removed, and is of a size to accommodate the falling bar 36.

Piston assembly 44 is used to compensate for any differential expansion and to maintain the pressures equal on opposed sides of membrane 70. For example, as tubing 26' filled with fluid is run into the well, the fluid moves from a relatively cool environment at the surface of the earth to a more heated environment at the bottom of the hole. Such a temperature change could cause either an expansion of the tubing 26' or an expansion of the fluid inside the tubing. Thus, piston 44 is permitted to compensate for any differential exapnsion between the recited components. Further, weep holes 72 provided in disk 70 permit a small amount of fluid flow to occur therethrough to assist in such compensation. Weep holes 72 also permit the release of air upon assembly. Once the tubing is filled with water, the piston is manually pushed downwardly and weep holes 72 permit air to pass therethrough. Further, there may be a large hydrostatic head on top of the frangible disk or barrier or diaphragm 70. A rigidly mounted frangible disk, for example, might break. Thus, piston 44 and weep holes 72 permit the assembly to compensate for such a pressure. Also, piston assembly 44 must withstand the downward force resulting from the circulation of fluid downward thereon prior to the fluid passing through ports 42.

The tool string 24 therefore includes the longitudinally extending axial passageway comprising a plurality of passageways 76, 78, 80 and 82, along with the passageway which extends through member 38.

The lower terminal end 84 of the barrier assembly is connected to the before-mentioned tubing release assembly 38 by means of threads 86, while the upper terminal end 88 is connected into the tubing string 26 by means of the threaded surface 89.

Figure 4:
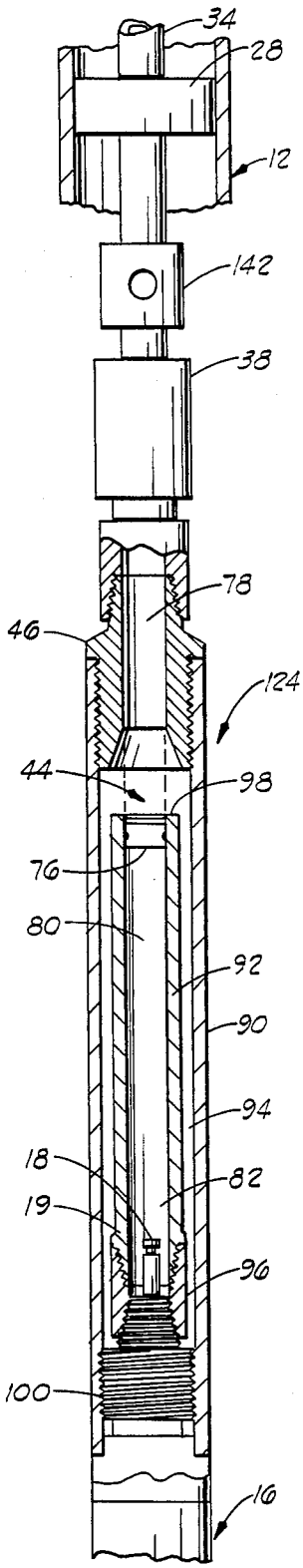
FIG. 4 is a schematic representation of an alternate embodiment of the present invention.

In the alternate embodiment set forth in FIG. 4, like or similar numerals (e.g. increased by 100) refer to like or similar elements wherever it is deemed logical to do so. The tool string 124 includes barrier assembly 44 which is connected below to a tubing release assembly 38, which in turn is connected to a vent assembly 142, as for example, the packer actuated vent assembly disclosed in U.S. Pat. Nos. 3,871,448; 3,931,855; 4,040,485; and 4,151,880.

The tool string includes an outer barrel 90 having opposed ends connected to connecting member 46 and to the gun firing head. An inner barrel 92 is encapsulated or isolated within the foregoing outer barrel. The inner barrel is free standing and includes an annulus 94 formed about the exterior thereof. Coupling 96 connects the inner barrel to the top of the gun firing head, with the pin assembly 18 being contained within the lower marginal end of the inner barrel assembly. The upper terminal end 98 of the inner barrel is provided with a suitable stop means, the details of which are not shown, for abuttingly engaging the upper face of piston 44 at the upper end of its stroke. The piston preferably is made in accordance with the teaching of FIGS. 2 and 3, and includes the before-mentioned passageway 76 therethrough which is closed by the disk 70.

The length of inner tube 92 is determined by the volume of the annular area around inner tube 92 for the collection of junk and debris. Because so much debris can fall to the bottom of the string, the size of the annular area is a limitation of the embodiment as compared to the preferred embodiment shown in FIG. 1.

The casing 12 must be large enough to permit the use of an outer tube 90, which in turn is large enough to have an inner tube 92 located on the interior thereof which will permit detonator bar 36 to freely fall through inner tube 92 for impact with the firing mechanism 18 of gun 16. Further, if outer tube 90 is too large, it becomes a restriction to the flow of producing fluid from the perforations since a large outer tube 90 would provide a very small annulus between outer tube 90 and casing 12 before the producing fluid reached vent assembly 142.

The tubing release 38 in FIG. 4 is located above piston 44, rather than below piston 44 as shown in FIG. 1, because it is not practical to locate it below piston 44 due to the size of outer tube 90. Outer tube 90 is so large that the space will not accommodate a tubing release below piston 44 as shown in FIG. 1.

Another modification of the embodiment shown in FIGS. 1 and 2 eliminates barrier assembly 40 and replaces firing mechanism 18 with an extended firing head that extends a substantial distance upward in the hole thereby permitting any debris to fall down around it. A small 1.4 inch firing head can extend 4 to 8 feet up into the tubing 26' such that the bar 36 engages the firing head above the debris which has collected in the bottom of tubing 26'. Thus the annular area around the firing head becomes a junk basket to collect debris. In essence, the firing head is brought above the debris collection area.

OPERATION OF THE FIRST EMBODIMENT

As shown in FIGS. 1 and 2, the tool string includes an upper tubing string 34, having a retrievable packer 28 mounted thereon; a perforated nipple 45 having ports 42; a barrier assembly 40 having a compensating piston 44; a tubing release assembly 38; and a perforating gun 16 having firing head 18. The tool string is made up piece by piece as each component is lowered into the borehole in a conventional manner. Tubing spring 26' is filled with fresh water and great care is taken as the closure member 44 is fitted into the barrier assembly sub so that all of the air under the piston is expelled through small apertures 72, and the piston is positioned about midway of its stroke. The disk 70 has previously been assembled to the piston 44 so that the piston closure member is in place, isolating chamber 19' from chamber 45 and therefore from well fluids.

As the remainder of the tool string is sent downhole on the end of the tubing string 34, differential expansion due to temperature and pressure differentials occurs between the noncompressible fluid and the remainder fluid or pipe of the system which causes the fluid captured beneath piston 44 to expand. This action forces piston 44 uphole towards the upper stop member.

The tool string 34 will retrievable packer 28 is lowered into the well until perforating gun 16 is adjacent formation 14. Since port 42 has been open as the tool string has been lowered into the well, tubing string 34 has been filled with mud and other debris. The packer is set with the gun being located adjacent to the payzone. The gun, however, can be left in this configuration for an extended length of time because there is no danger of debris accumulating about the pin assembly of the gun firing head. Debris falling down the tubing string cannot gravitate toward the pin assembly because of the presence of the barrier assembly 40. If desired, the vent ports may be slanted outward and downward, rather than being horizontal as shown, so as to eliminate debris which otherwise tends to accumulate above the piston of assembly 44 in proximity of the vent ports 42. The upper terminal end of the upper tubing 34 can be closed and the entire system left dormant until it is desired to complete the well.

To complete the well, and before the packer is set, circulation or cleaning fluids are pumped down tubing string 34 to force the mud and debris to pass through port 42 and back up the annulus between tubing string 34 and the cased borehole 12. Thus, the mud and debris is circulated out ports 42, and tubing string 34 is washed clean down to piston 44. Thus, the debris, such as mud laden with rust, scale, pieces of cement particles, and rags, are washed out of the tubing string 34. Once tubing string 34 is washed clean and the mud has been replaced with a lighter fluid, packer 28 can be set. A permanent packer cannot be used with this tool string if the permanent packer would prevent circulation up the annulus between tubing string 34 and cased borehole 12.

Now there is clean fluid extending from the surface to barrier assembly 40, and from barrier assembly 40 to perforating gun 16. The upper terminal end of the upper tubing string is opened, and detonator bar 36 is dropped down tubing string 34. The bar free falls until it engages the disk 70 of piston 44, whereupon the inertia of the bar ruptures the disk and the bar continues to fall downhole until it strikes the pin assembly of the gun firing head. The inertia from arresting the bar detonates the shaped charges of the gun, and perforates the casing, forming tunnels back up into the payzone so that formation fluid is free to flow back through the tunnels and perforations, into the lower annulus, where the fluid flows up to the vents, into the lower tubing string, up through the packer, and to the surface of the ground where the produced fluid can be gathered.

Although it is intended that the tool string shown in FIGS. 1 and 2 is run in the open position rather than with a packer actuated vent between the packer and perforating gun, an underbalance or pressure differential may still be achieved. After the packer is set, fluids below the packer and around the tubing string 26' will flow into ports 42 and reach static equilibrium until the well has been perforated. Depending upon the amount of underbalance or differential pressure desired, the clean fluid in tubing 34 may then be swabbed out and completely removed to obtain a maximum differential pressure or some predetermined column of lighter fluid may be maintained in tubing 34 to realize a predetermined pressure differential for backsurging. In the latter case, nitrogen can be pumped into the tool string 34 to force a portion of the fluid out of tubing string 34 prior to the setting of packer 28. Later, the nitrogen can be bled off to provide a predetermined hydrostatic head within tubing string 34.

OPERATION OF THE ALTERNATE EMBODIMENT

In the embodiment disclosed in FIG. 4, the inner barrel is filled with incompressible clean fluid at 80, the piston is placed into operative position, and a stop means at 98 placed at the end of the inner barrel. The gun is run downhole and positioned adjacent to the payzone in the before-described manner.

Debris falling down the thousands of feet of tubing string enters the passageway 78 of the upper subassembly 46, and continues to fall into the annulus 94 formed between the inner and outer barrels, where the debris can do no harm to the gun firing head because the small amount of debris which may accumulate on top of the piston is insufficient to obscure the pin assembly. The annular chamber 94 can be made with ample capacity to accommodate the heavies which stratify from the long column of well fluids.

When it is time to complete the well, a lubricator is usually placed at the upper end of the upper tubing string, and the bar is dropped down through the interior of the tubing string where the bar falls through passageway 78, through the annular piston 44 as the disk thereof is ruptured, through the passageway 80 of the inner barrel 92, and into contact with the pin assembly of the gun firing head, whereupon the gun is discharged and the casing perforated. Production is carried out by formation fluid flowing into the casing annulus, up the lower casing annulus, into the vent 142, and up the tubing string to the surface of the ground.

FURTHER DESCRIPTION OF PREFERRED EMBODIMENT

Figure 7:
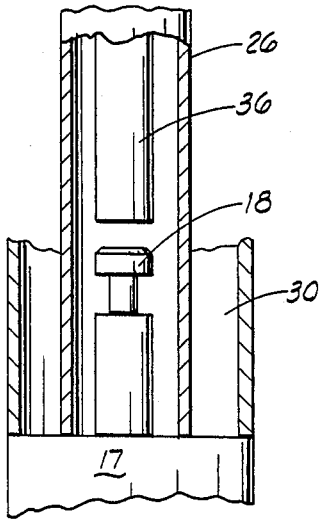
FIG. 7 is a fragmentary view which discloses the lower end of FIG. 4, with a detonator about to strike.
Figure 8:
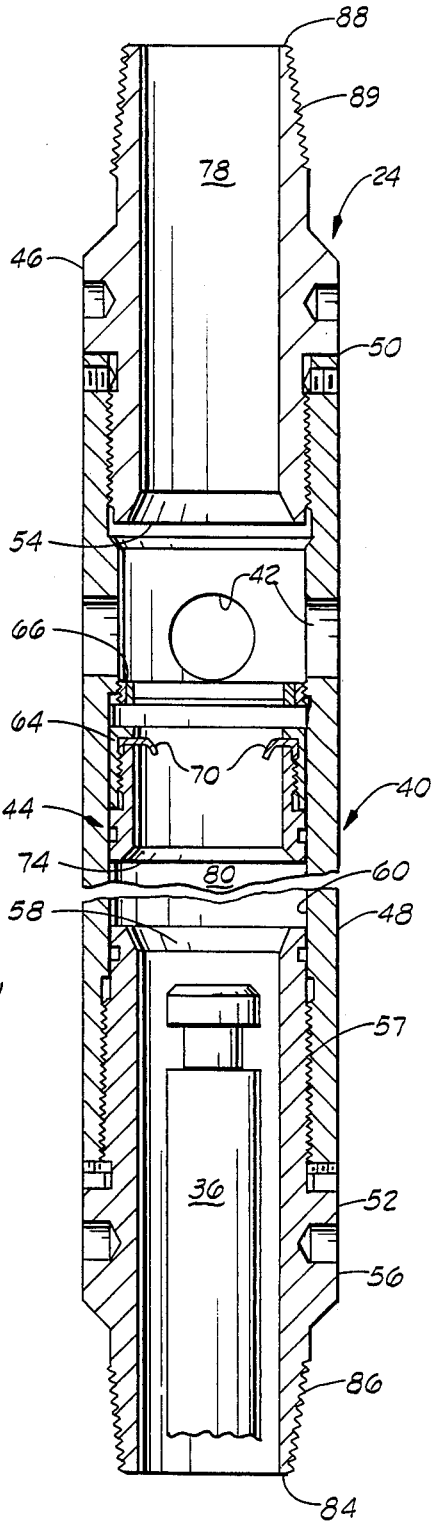

FIG. 6 illustrates the configuration of the first embodiment of the invention after the bar 36 has passed through and ruptured the frangible disk. FIG. 7 illustrates the bar immediately prior to striking the firing pin of the firing head.

The present invention isolates the immediate area above the gun firing head from the downhole well fluid so that debris cannot obscure the gun firing mechanism and prevent subsequent firing of the gun. The barrier means preferably is in the form of a piston which facilitates loading the lower tubing with clean fluid, and subsequently accommodates any differential expansion of the gun components. The frangible disk may be perforated to enable compressible fluids to escape from below the piston during assembly so that only fresh fluid is contained about the firing head.

It is very costly and impractical to substitute clean fluid for the debris laden fluid contained within a wellbore. The present invention resolves this problem by providing a means by which debris-like material is caused to accumulate in an area where it can do no harm to the perforating operation.

While a preferred embodiment of the invention has been shown and described, modifications thereof can be made by one skilled in the art without departing from the spirit of the invention.

We claim:

1. A method of completing a well formed by a well bore having fluid therein intersecting one or more formations of the earth, said method comprising the steps of:

providing a perforating gun having a gun firing head associated therewith;

forming a fluid chamber above the gun firing head associated with the perforating gun and in fluid communication therewith;

filling with fluid the fluid chamber above the gun firing head associated with the perforating gun;

running the perforating gun with the fluid chamber formed thereabove into said well bore to a desired location therein adjacent one of said formations therein;

compensating for a pressure differential inside the fluid chamber formed above the gun firing head associated with the perforating gun with the pressure of said fluid in said well bore outside of the fluid chamber as said perforating gun is being run into said well bore;

transmitting a gun firing force into the chamber to contact the gun firing head associated with the perforating gun thereby perforating the well bore and a portion of one of said formation; and producing fluid from one of said formations into said well bore.

2. The method of claim 1 further comprising the steps of:

providing a packer; and setting the packer to divide said well bore into an upper portion and lower portion, the perforating gun being in the lower portion of said well bore.

3. The method of claim 1 further comprising the steps of:

placing a fluid barrier at the upper end of the fluid chamber.

4. The method of claim 1 wherein the step of transmitting a gun firing force into the chamber comprises:

dropping an object into said well bore to penetrate the fluid chamber above the gun firing head and contact the gun firing head to actuate the same.

5. The method of claim 1 wherein the step of forming a fluid chamber above the gun firing head associated with the perforating gun comprises:

placing a piston within the fluid chamber;

closing the piston with a disk-like member which is subsequently ruptured by the gun firing force transmitted into the chamber to contact the gun firing head associated with the perforating gun; and filling the chamber with substantially imcompressible fluid prior to detonating the perforating gun.

6. The method of claim 1 further comprising the step of:

placing a vent immediately above the fluid chamber.

7. The method of claim 2 further comprising the steps of:

placing a vent above the fluid chamber and below the packer; and forming a flow path from the surface of said earth into the lower portion of the well bore.

* * * * *